US005123579A

United States Patent [19]

Sugiyama

[11] Patent Number: 5,123,579

[45] Date of Patent: Jun. 23, 1992

[54] KEY HOLDING APPARATUS

[76] Inventor: Toshiichi Sugiyama, 25-25, Fujioka 5-chome, Fujieda-shi, Shizuoka, Japan

[21] Appl. No.: 539,414

[22] Filed: Jun. 13, 1990

[30] Foreign Application Priority Data

Jul. 7, 1989 [JP] Japan ..... 1-174194

[51] Int. Cl.[5] ..... A44B 11/00

[52] U.S. Cl. ..... 224/163; 70/456 R

[58] Field of Search ..... 224/163; 24/163 K; 206/37.1, 37.8, 38.1, 234; 70/456 R

[56] References Cited

U.S. PATENT DOCUMENTS

| | | | |
|---|---|---|---|
| 1,753,765 | 4/1930 | Withers | 224/163 |
| 1,795,291 | 3/1931 | Dunn | 206/234 |
| 1,999,290 | 4/1935 | Goessling | 206/37.8 |
| 2,854,132 | 9/1958 | Bjerknes | 70/456 |
| 3,618,346 | 11/1971 | Humphrey . | |
| 3,813,907 | 6/1974 | Jones, Jr. et al. . | |
| 3,832,874 | 9/1974 | Willis . | |
| 4,113,157 | 9/1978 | Woodbury | 224/163 |
| 4,596,126 | 6/1986 | Sorensen . | |
| 4,653,299 | 3/1987 | Kim . | |
| 4,753,377 | 6/1988 | Poluhowich | 224/163 |

FOREIGN PATENT DOCUMENTS

| | | |
|---|---|---|
| EP88/01191 | 6/1989 | European Pat. Off. . |
| 461719 | 2/1937 | United Kingdom . |

*Primary Examiner*—Linda J. Sholl

*Attorney, Agent, or Firm*—Lowe, Price, LeBlanc & Becker

[57] ABSTRACT

At least one key body formed with tooth-like projections, and a grip section gripped in use are formed separately from each other. The key body is mounted to a hollow portion of the grip section so as to be extensible and retractable with respect thereto, by angular movement of sliding movement. In order to retain a plurality of key bodies compactly, the key bodies are mounted to a single grip section. Further, in order to prevent loss and burglary and to facilitate carrying, the grip section having the key bodies accommodated therein is detachably held in a key holder such as a bracelet, a buckle of a belt, or the like.

1 Claim, 4 Drawing Sheets

KEY HOLDING APPARATUS

BACKGROUND OF THE INVENTION

1. Field of the Invention

The present invention relates to a key holding apparatus that is handy to carry.

2. Description of the Prior Art

Almost everyone requires a plurality of keys such as a key for an automotive vehicle, a key for the home and so on. Conventionally, the keys are held in a key holder and are carried.

When a plurality of large keys are mounted to the key-holder, however, the volume of the key holder further increases. Thus, if the key holder is put into a pocket or the like, the key holder is bulky. Moreover, there occurs such a fear that the cloth is damaged by tooth-like notches of the keys or the key holder.

For the reason discussed above, the inventor of this application has proposed, in Japanese Patent Provisional Publication Nos. 304883/1988 and 70009/1989, a key comprising at least one key body and a grip section formed separately from the key body, the key body having a head end which is pivoted to one end of the grip section, and a key unit comprising the key and a key holder provided therein with a cavity or void within which the key is accommodated, the key holder being mounted to a band. The inventor has further proposed in a buckle having detachably accommodated therein a key, in Japanese Patent Provisional Publication Nos. 70006/1989 and 218402/1989. Moreover, the inventor has proposed a bracelet, a necklace and a brooch having detachably accommodated therein a key, in Japanese Patent Provisional Publication No. 70008/1989.

SUMMARY OF THE INVENTION

It is a principal object of the invention to provide a key holder which is small in size and easy in carrying, and which can use a plurality of key bodies.

In order to achieve the above object, a key holder according to the invention comprises a plurality of key bodies and a grip section formed separately from the key bodies, the plurality of key bodies being mounted to the single common grip section, in an extensible and retractable manner with respect to the grip section.

The single grip section can be settled with respect to the plurality of key bodies, by the fact that the key bodies are extensible and retractable with respect to the single grip section. Thus, the key holder is compact in construction and does not serve as a hindrance. Further, since the plurality of key bodies are collected together, the key holder is handy to carry.

Moreover, since the key bodies are accommodated in the grip section when the keys are not used, there is no such a fear that tooth-like projections on the key bodies are caught to a lining cloth of a bag or a cloth of a pocket.

It is another object of the invention to provide a key provided with a key holder such as a buckle of a belt, a bracelet, a wrist strap, or the like which accommodates and holds at least one key body and a grip section, in order to prevent stealing or burglary and loss of the key.

The key body and the grip section are accommodated in the key holder, and can always be carried on one's person. Thus, it is possible to prevent misplacement, loss and burglary of the key.

It is a further object of the invention to provide a key holder in which an opening is formed in longitudinal one end of a grip section in the form of a hollow box, at least one key body extends through the opening, and the key body is accommodated within the grip section for sliding movement longitudinally.

DETAILED DESCRIPTION OF THE PREFERRED EMBODIMENTS

Figure 1:
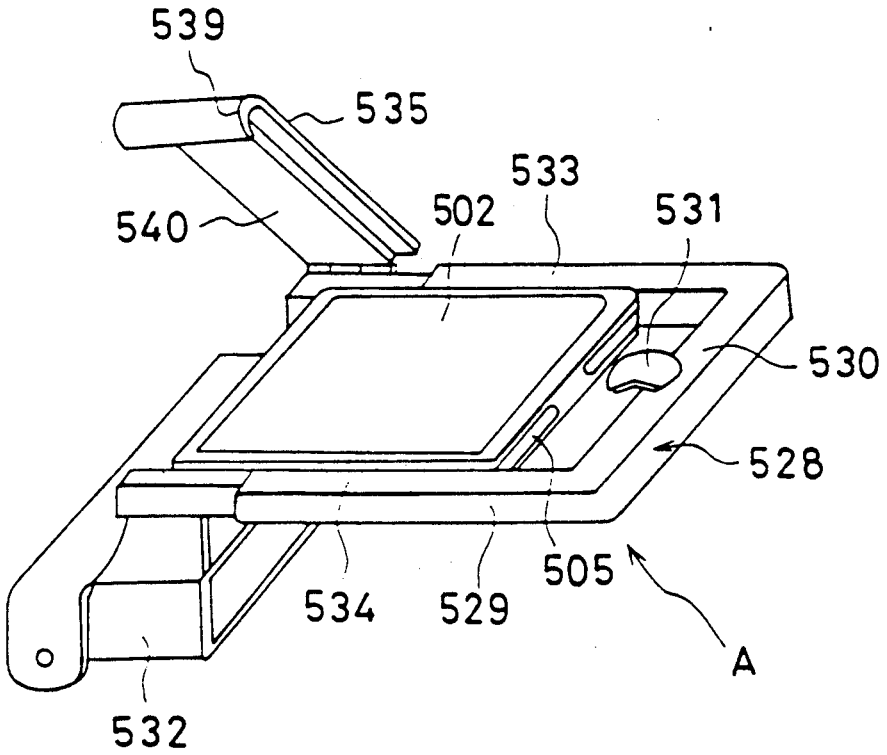
FIG. 1 is a perspective view of a key according to an eighth embodiment of the invention.
Figure 2:
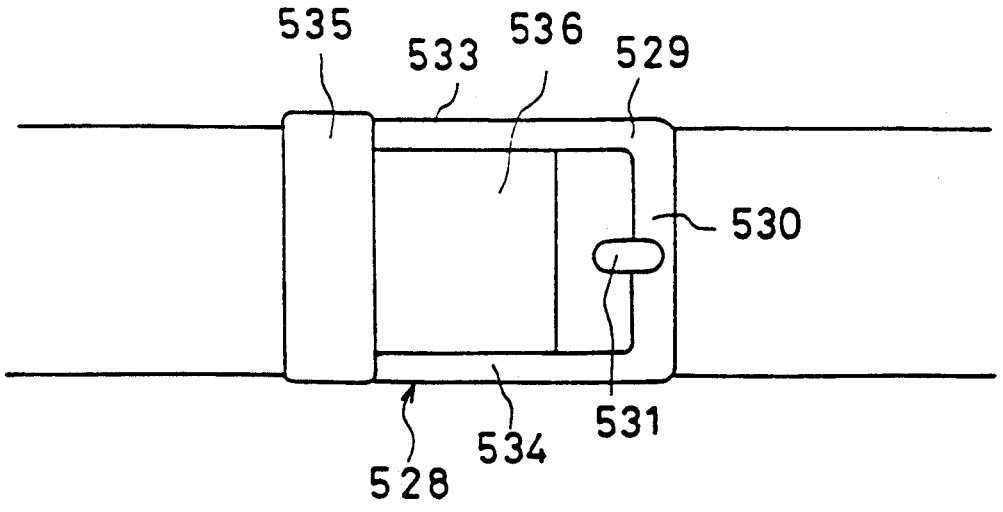
FIG. 2 is a top plan view of a buckle illustrated in FIG. 1.

FIG. 1 shows a key holder which comprises a key holder formed by a buckle 528. As shown in FIG. 2, the buckle 528 has a frame 529 which has three lateral sides 530, 533 and 534. A latching element 531 is provided on an upper face of the lateral side 530 and extends inwardly. A belt fastener 532 is provided at a lower face of a side edge of the buckle 528, which is opposite to the lateral side 530. A retaining element 535 is provided on the upper face of the other side edge of the buckle 528 and extends from the upper side 533 of the frame 529 to the lower side 534 thereof. A lower face plate 536 is provided at the entire bottom surface of the frame 529 or a part of the bottom surface thereof.

The retaining element 535 has one end thereof which is mounted to the upper side 533 of the frame 529 for angular movement about an axis extending along the upper side 533. The other end of the retaining element 535 is formed with an engaging section 539 which is bent downwardly and which is detachably engageable with the lower side 534 of the frame 529. A step 540 is formed at an outward portion of the lower face of the retaining element 535.

Figure 3:
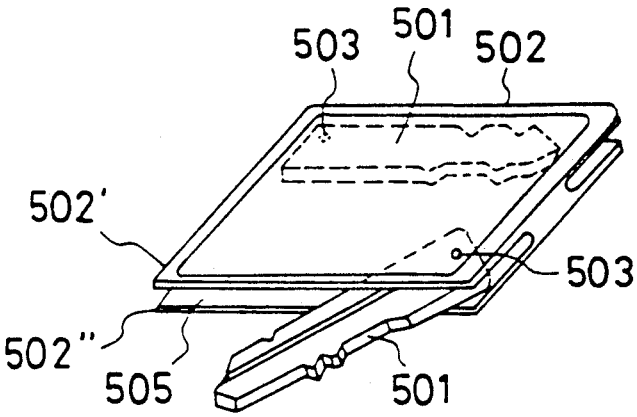
FIG. 3 is a perspective view of a plurality of key bodies and a grip section illustrated in FIG. 1.
Figure 4:
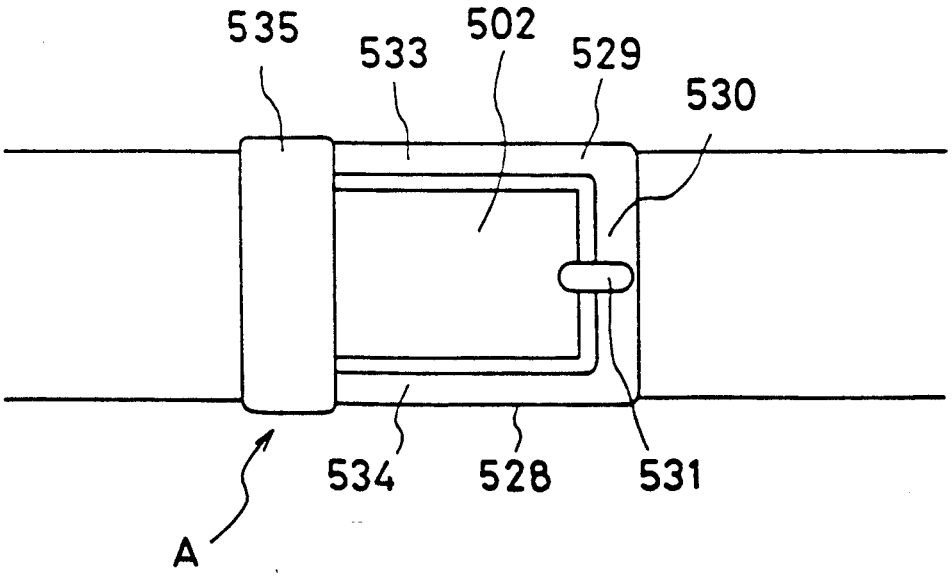
FIG. 4 is a perspective view of the key under carrying, illustrated in FIG. 1.

A grip section 502 shown in FIG. 3 comprises a pair of plates 502' and 502. The pair of plates 502' and 502'' are superimposed upon each other with a hollow portion 505 defined therebetween. A plurality of key bodies 501 are arranged in side-by-side relation in the hollow portion 505. Each of the key bodies 501 is mounted to the grip section 502 for angular movement in a plane about its corresponding pivot 503 with respect to the grip section 502 in such a manner that the key body 501 is extensible and retractable with respect to the grip section 502. Mounting of the key bodies 501 and the grip section 502 to the buckle 528 is practiced as follows. That is, as shown in FIG. 1, the other end of the retaining element 535 is angularly moved upwardly to its open position. The grip section 502 having accommodated therein the key bodies 501 is then fitted in the frame 529, and is slidingly moved toward the lateral side 530 so that the grip section 502 is engaged with the lower face of the latching element 531. Subsequently, as shown in FIG. 4, the other end of the retaining element 535 is angularly moved downwardly to engage the engaging section 539 with the lower side 534 of the frame element 529. By doing so, the latching element 531 and the retaining element 535 prevent the key holder from escaping upwardly, and the step 540 of the retaining element 535 prevents the grip section 502 from being slidingly moved laterally and from falling down.

Figure 5:
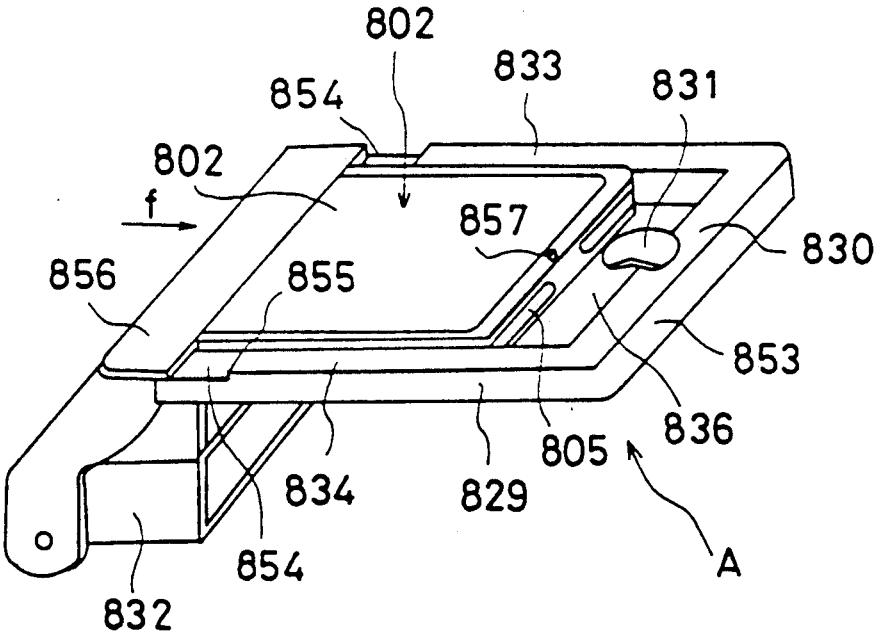
FIG. 5 is a perspective view of a key according to another embodiment of the invention.
Figure 6:
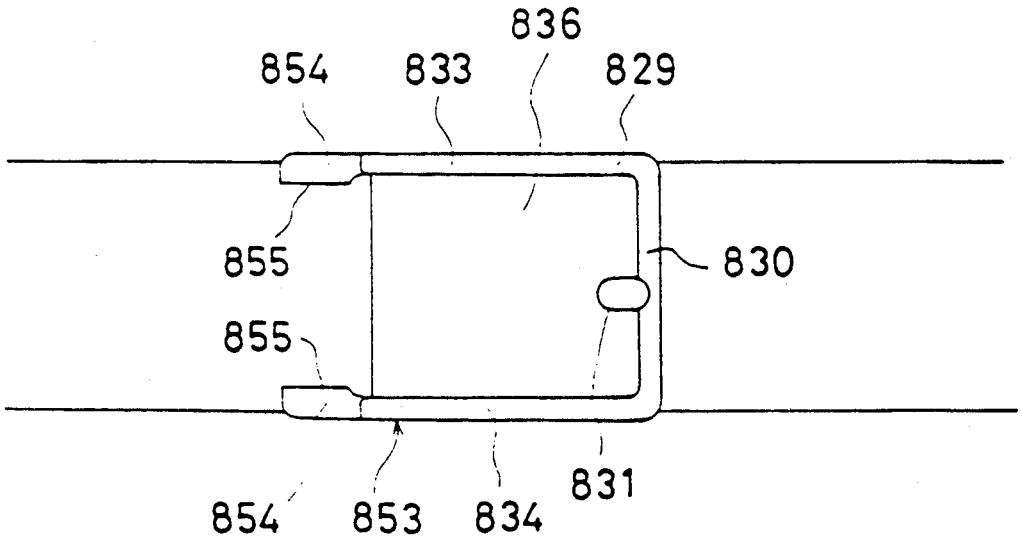
FIG. 6 is a top plan view of a buckle illustrated in FIG. 5.

FIG. 5 shows a key holder which comprises a key holder in the form of a buckle 853. The buckle 853 has a frame 829 which has a C-shaped configuration in plan and which is provided with a bottom wall 836. The frame 829 has an upper side 833 and a lower side 834 whose respective forward ends are formed respectively with slightly low steps 854 and 854. As shown in FIG. 6, the steps 854 and 854 have their respective inner edges which are formed respectively with opposed engaging projections 855 and 855. Providing of a lateral side 830 of the frame 829 with a latching element 831 and provision of the frame 829 with a belt fastener 832 are the same as those of the embodiment illustrated in FIG. 1.

Each of the key bodies 801 and a grip section 802 have their respective constructions (not shown in FIGS. 5 and 6 for simplicity) which are substantially the same as those of the embodiment illustrated in FIG. 3. In the embodiment illustrated in FIG. 5, however, an extension plate 856 is provided at longitudinal one end of an upper plate 802' and is superimposed upon the step 854 of the buckle 853. A projection 857 is provided on the upper face of the other longitudinal end of the upper plate 802' and is engageable with the latching element 831.

In no use of the key holder, the key bodies 801 are accommodated within a hollow portion 805 in the grip section 802. The grip section 802 is fitted in the frame 829 with the projection 857 directed inwardly of the frame 829. The engaging projections 855 and 855 of the buckle 853 are fitted in the hollow portion 805. The grip section 802 is slidingly moved in the arrow f in FIG. 5. The projection 857 is engaged with the lower face of the latching element 831 so that the extension plate 856 rests on the steps 854 and 854 and is abutted against the upper and lower sides 833 and 834 of the frame 829.

When the key holder is taken out of the buckle 853, operation should be made reversely or conversely to take the key bodies 801 and the grip section 802 out of the buckle 853.

In connection with the above, the key holder may be retained by the buckle 853 in the following manner. That is, in place of the frame 829 having the bottom wall 836, a frame having a circular cross-sectional configuration is bent into a configuration having an upper side, a lower side and one lateral side. A pair of hollow portions at respective sides of the grip section 802 are fitted in a curved surface on the inside of the frame. In this manner, the key holder is retained by the buckle 853.

Further, in the case of the key holder comprising a plurality of key bodies, numbers or marks of different color from each other may be applied to the respective key bodies. This is convenient, because it is possible to then easily distinguish the key bodies from each other as to where the key bodies should be used. Moreover, if decoration such as color, sculpture or the like is applied to surfaces of the respective grip section, buckle, key bodies and the like, there is obtained a beautiful or pretty design. A chain may be mounted to one end of the grip section or to one end of each of the key bodies to form a necklace.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. A key holding apparatus, comprising:

a grip section, having a pair of plates superimposed upon each other to define a hollow portion therebetween;

at least one key body mounted to said grip section so as to be extensible from and retractable into said hollow portion; and a key holder in the form of a buckle having a belt fastener, wherein said key holder has an upper side, a lower side and a lateral side extending between opposite ends of the respective upper and lower sides, wherein said key holder has, at its inner periphery, a frame in which said grip section is fitted, wherein said lateral side of said key holder has an upper face with an inner edge provided with a latching element for retaining one end of said grip section, wherein the other ends of the respective upper and lower sides have respective inner peripheries formed respectively with engaging projections fitted in said hollow portion of said grip section, wherein said key holder further has a lower face plate provided at a bottom face of said frame, wherein one end of said grip section has an upper face provided with a projection engageable with said latching element, and said grip section holds two keys lying substantially in a common plane, with each key mounted to pivot about a respective one of two parallel axes so as to be extensible by rotation in mutually opposite directions.

* * * * *